US007227514B2

(12) United States Patent
Lee

(10) Patent No.: US 7,227,514 B2
(45) Date of Patent: Jun. 5, 2007

(54) APPARATUS AND METHOD FOR DRIVING PLASMA DISPLAY PANEL

(75) Inventor: Jun-Young Lee, Cheonan (KR)

(73) Assignee: Samsung SDI Co., Ltd, Suwon-si (KR)

( * ) Notice: Subject to any disclaimer, the term of this patent is extended or adjusted under 35 U.S.C. 154(b) by 365 days.

(21) Appl. No.: 10/613,494

(22) Filed: Jul. 1, 2003

(65) Prior Publication Data

US 2004/0008163 A1 Jan. 15, 2004

(30) Foreign Application Priority Data

Jul. 9, 2002 (KR) ..... 10-2002-0039713

(51) Int. Cl.
*G09G 3/28* (2006.01)

(52) U.S. Cl. ..... 345/60; 345/41; 315/169.4

(58) Field of Classification Search ..... 345/60, 345/67, 66, 41, 42, 62, 55; 315/169.4
See application file for complete search history.

(56) References Cited

U.S. PATENT DOCUMENTS 5,670,974 A * 9/1997 Ohba et al. ..... 345/60
6,657,604 B2 * 12/2003 Huang et al. ..... 345/60
2002/0033675 A1 * 3/2002 Kang et al. ..... 315/169.1
2002/0097203 A1 * 7/2002 Onozawa et al. ..... 345/67
2002/0175883 A1 * 11/2002 Onozawa et al. ..... 345/67
2003/0006716 A1 * 1/2003 Chae ..... 315/169.3
2003/0025459 A1 2/2003 Lee et al.
2003/0122735 A1 * 7/2003 Huang et al. ..... 345/60
2003/0201726 A1 * 10/2003 Kang et al. ..... 315/169.1

FOREIGN PATENT DOCUMENTS

EP 1 227 463 7/2002
JP 3201603 2/2002

* cited by examiner

*Primary Examiner*—Amr A. Awad
*Assistant Examiner*—Seokyun Moon
(74) *Attorney, Agent, or Firm*—Christie, Parker & Hale, LLP

(57) ABSTRACT

In an apparatus for driving a PDP, first and second switches are coupled in series between a power source V1 for supplying a voltage Vs/2 and a first terminal of the panel capacitor, and third and fourth switches are coupled in series between the first terminal of the panel capacitor and a power source V2 for supplying a voltage −Vs/2. A capacitor is coupled between a contact of the first and second switches and a contact of the third and fourth switches, and is charged to voltage Vs/2. The withstand voltages of the first and second switches are clamped to the voltage Vs/2 while the voltage −Vs/2 is applied to the first terminal of the panel capacitor. Likewise, the withstand voltage of the third and fourth switches are clamped to the voltage Vs/2 while the voltage Vs/2 is applied to the first terminal of the panel capacitor.

18 Claims, 11 Drawing Sheets

APPARATUS AND METHOD FOR DRIVING PLASMA DISPLAY PANEL

CROSS REFERENCE TO RELATED APPLICATIONS

This application claims priority to and the benefit of Korean Patent Application No. 2002-39713 filed on Jul. 9, 2002 in the Korean Intellectual Property Office, the content of which is incorporated herein by reference.

BACKGROUND OF THE INVENTION (a) Field of the Invention

The present invention relates to an apparatus and method for driving a plasma display panel (PDP).

(b) Description of the Related Art

In recent years, flat panel displays such as liquid crystal displays (LCD), field emission displays (FED), PDPs, and the like have been actively developed. The PDP is advantageous over other flat panel displays in regard to its high luminance, high luminous efficiency, and wide view angle, and accordingly, it is favorable for making a large-scale screen of more than 40 inches as a substitute for the conventional cathode ray tube (CRT).

The PDP is a flat panel display that uses plasma generated by gas discharge to display characters or images, and it includes, according to its size, more than several scores to millions of pixels arranged in a matrix pattern. Such a PDP is classified as a direct current (DC) type and an alternating current (AC) type according to its discharge cell structure and the waveform of the driving voltage applied thereto.

The DC PDP has electrodes exposed to a discharge space, allowing DC to flow through the discharge space while voltage is applied, and hence it requires resistors for limiting the current. Contrarily, the AC PDP has electrodes covered with a dielectric layer that naturally forms a capacitance component that limits the current and protects the electrodes from the impact of ions during a discharge. Thus the AC PDP is superior to the DC PDP in regard to long lifetime.

Typically, the driving method of an AC PDP is sequentially composed of a reset step, an addressing step, a sustain discharge step, and an erase step.

In the reset step, the state of each cell is initialized in order to readily perform an addressing operation on the cell. In the addressing step, wall charges are accumulated on selected "on"-state cells and other "on"-state cells (i.e., addressed cells) for selecting "off"-state cells on the panel. In the sustain discharge step, a sustain pulse is applied alternately to scan electrodes (hereinafter referred to as "Y electrodes") and sustain electrodes (hereinafter referred to as "X electrodes") to perform a discharge for displaying an image on addressed cells.

In the AC PDP, the Y and X electrodes for such a sustain discharge act as a capacitive load, and a capacitance exists for the Y and X electrodes (hereinafter referred to as "panel capacitor Cp").

Now, a description will be given as to a driver circuit for a conventional AC type PDP and its driving method.

FIGS. 1 and 2 are illustrations showing a conventional driver circuit and its operating waveform.

The driver circuit generating a sustain pulse as suggested by Kishi et al. (Japanese Patent No. 3,201,603) comprises, as shown in FIG. 1, Y electrode driver 11, X electrode driver 12, Y electrode power supplier 13, and X electrode power supplier 14. X electrode driver 12 and X electrode power supplier 14 are the same in construction as Y electrode driver 11 and Y electrode power supplier 13, and will not be described in detail in the following description.

Y electrode power supplier 13 comprises capacitor C1, and three switches SW1, SW2, and SW3. Y electrode driver 11 comprises two switches SW4 and SW5. Switches SW1 and SW2 in the Y electrode power supplier 13 are coupled in series between power source V1 and ground terminal 0. Power source V1 supplies a voltage Vs/2, and the voltage Vs is sustain discharge voltage. One terminal of capacitor C1 is coupled to the contact of switches SW1 and SW2, and switch SW3 is coupled between the other terminal of capacitor C1 and ground terminal 0.

Switches SW4 and SW5 of Y electrode driver 11 are coupled in series to both terminals of capacitor C1 of Y electrode power supplier 13. The contact of switches SW4 and SW5 is coupled to panel capacitor Cp.

As shown in FIG. 2, when switches SW1, SW3, and SW4 are turned on, with switches SW2 and SW5 off, Y electrode voltage Vy is increased to Vs/2 and capacitor C1 is charged with the voltage Vs/2. Subsequently, when switches SW1, SW3, and SW4 are turned off and switches SW2 and SW5 are turned on, the Y electrode voltage Vy is decreased to −Vs/2 by the voltage Vs/2 charged in capacitor C1.

Through this driving operation, positive voltage +Vs/2 and negative voltage −Vs/2 can be alternately applied to the Y electrodes. Likewise, positive voltage +Vs/2 and negative voltage −Vs/2 can be alternately applied to the X electrodes. The voltages ±Vs/2 respectively applied to the X and Y electrodes have an inverted phase with respect to each other. By generating a sustain pulse swinging between −Vs/2 and +Vs/2, the potential difference between X and Y electrodes can be maintained at the sustain discharge voltage Vs.

Such a driver circuit can employ elements of a low withstand voltage, because the withstand voltage of each element in the circuit is Vs/2. However this driver circuit is applicable only to plasma display panels using a pulse swinging between −Vs/2 and +Vs/2.

In addition, the capacitor for storing the voltage used as a negative voltage in this circuit must have a large capacity, so that a considerable amount of an inrush current flows in an initial starting step due to the capacitor.

SUMMARY OF THE INVENTION

In accordance with the present invention, a PDP driving circuit for using switches having the low withstand voltage is provided. The present invention applies a voltage to a contact of serially coupled switches, the voltage clamping the voltage of both terminals of the switches In one aspect of the present invention, an apparatus for driving a PDP is provided, the PDP having a panel capacitor. In the apparatus, first and second switches are coupled in series between a first power source for supplying a first voltage and a first terminal of the panel capacitor, and third and fourth switches are coupled in series between the first terminal of the panel capacitor and a second power source for supplying a second voltage. A first capacitor is coupled between a contact of the first and second switches and a contact of the third and fourth switches. A fifth switch is coupled between the first capacitor and a third power source supplying a third voltage.

Preferably, the fifth switch is turned on so that the first capacitor is charged to the difference between the first and third voltages, and the third voltage is substantially a middle voltage between the first and second voltages.

The apparatus further includes at least one inductor coupled to the first terminal of the panel capacitor; and sixth and seventh switches coupled in parallel between the inductor and the third power source.

It is preferable that the first to fourth switches have a body diode.

The apparatus may further include: sixth and seventh switches coupled in series between the first power source and a second terminal of the panel capacitor; eighth and ninth switches coupled in series between the second terminal of the panel capacitor and the second power source; a second capacitor coupled between a contact of the sixth and seventh switches and a contact of the eighth and ninth switches; and a tenth switch coupled between the second capacitor and the third power source.

In another aspect of the present invention, an apparatus for driving a PDP, the PDP having the panel capacitor, is provided. In the apparatus, first and second switches are coupled in series between a first power source supplying a first voltage and a first terminal of the panel capacitor, and third and fourth switches are coupled in series between the first terminal of the panel capacitor and a second power source supplying a second voltage. A first signal line is coupled to a contact of the first and second switches, and a second signal line is coupled to a contact of the third and fourth switches. A voltage between the first and second signal lines is a third voltage. The first and second voltages are alternately applied to the first terminal of the panel capacitor.

It is preferable that the third voltage is substantially a middle voltage between the first and second voltages.

Preferably, the apparatus further includes a capacitor coupled between the first and second signal lines and charged to the third voltage. A fifth switch may be coupled between a third power source supplying a voltage substantially corresponding to a summation of the second and third voltages, and be turned on thereby charging the capacitor to the third voltage in the on state of the fourth switch.

The apparatus preferably includes a power recovery section which comprises at least one inductor coupled to the first terminal of the panel capacitor. The power recovery section changes a terminal voltage of the panel capacitor using a resonance generated between the inductor and the panel capacitor.

In still another aspect of the present invention, a method for driving a PDP is provided, the PDP being driven by alternately applying first and second voltages through first and second signal lines coupled to a first terminal of a panel capacitor. The method includes: applying a third voltage between a contact of first and second switches formed on the first signal lines and a contact of third and fourth switches formed on the second signal lines, while the first voltage is applied to the first terminal of the panel capacitor by turning on the first and second switches; and applying the third voltage between the contact of the first and second switches and the contact of the third and fourth switches, while the second voltage is applied to the first terminal of the panel capacitor by turning on the third and fourth switches.

Preferably, a capacitor coupled between the contact of the first and second switches and the contact of the third and fourth switches is charged to the third voltage.

DETAILED DESCRIPTION

First, reference will be made to FIG. 3 to describe the schematic structure of a PDP according to an embodiment of the present invention.

Figure 1:
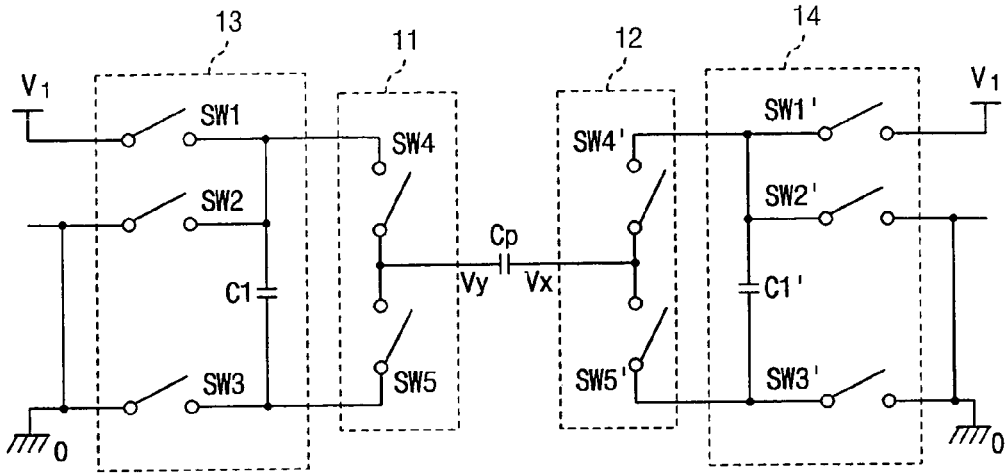
Fig. 1 (PRIOR ART)
FIG. 1 is a schematic diagram of a driver circuit according to prior art.
Figure 2:
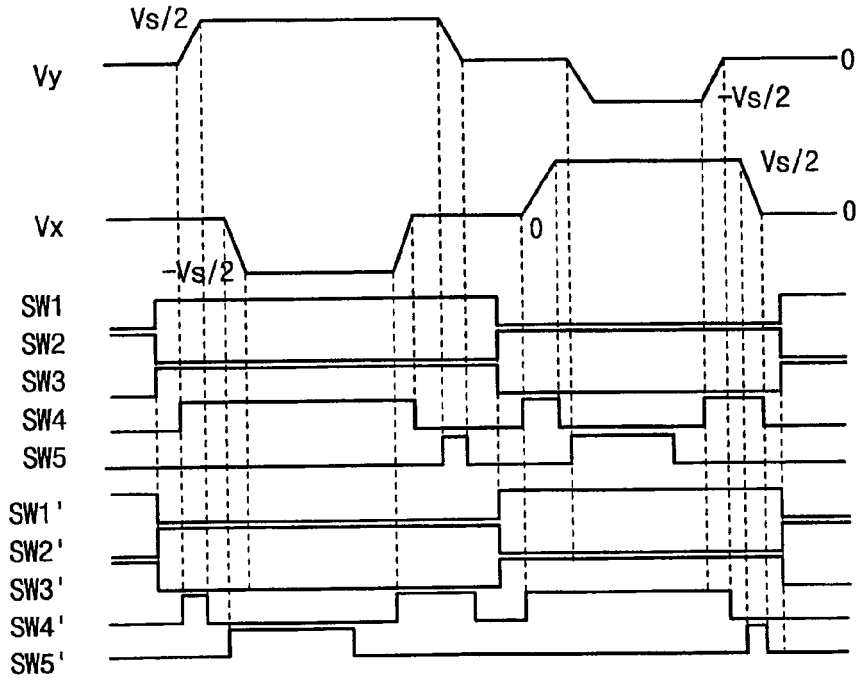
Fig. 2 (PRIOR ART)
FIG. 2 is a timing diagram showing a driving operation of the driver circuit according to prior art.
Figure 3:
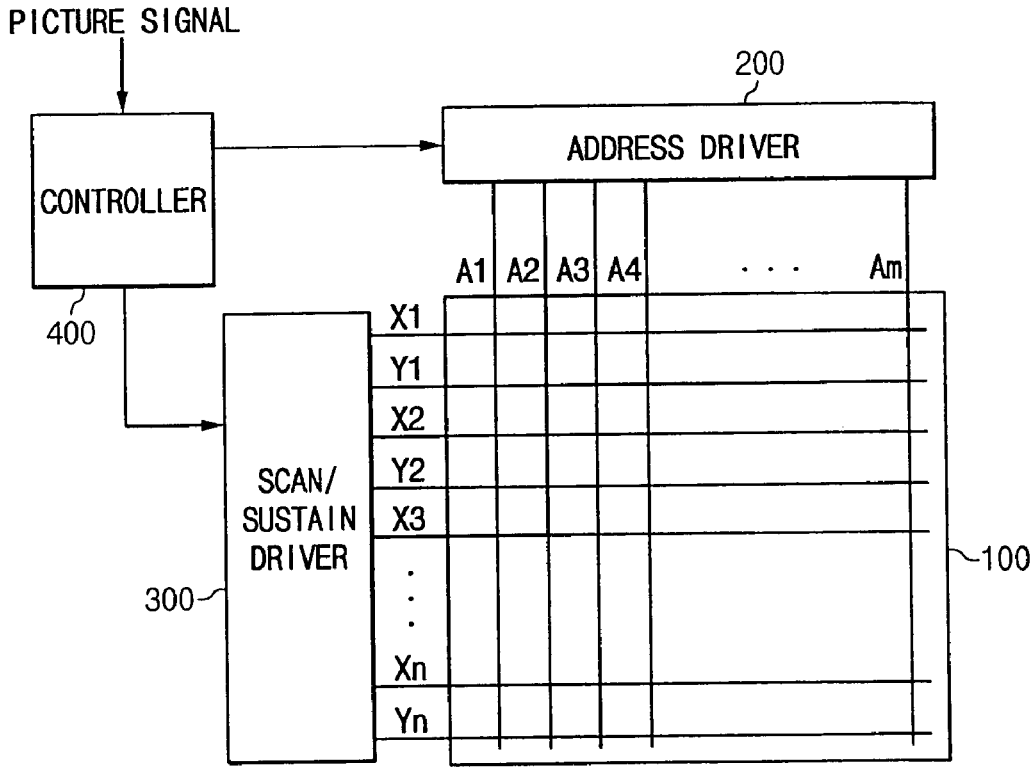
FIG. 3 is a schematic diagram of a plasma display panel according to the present invention.

FIG. 3 is a schematic of the PDP according to the embodiment of the present invention.

The PDP according to the embodiment of the present invention comprises, as shown in FIG. 3, plasma panel 100, address driver 200, scan/sustain driver 300, and controller 400.

Plasma panel 100 comprises a plurality of address electrodes A1 to Am arranged in columns, and a plurality of scan electrodes (hereinafter referred to as "Y electrodes") Y1 to Yn and sustain electrodes (hereinafter referred to as "X electrodes") X1 to Xn alternately arranged in rows. Address driver 200 receives an address drive control signal from controller 400, and applies a display data signal for selection of discharge cells to be displayed to the individual address electrodes. Scan/sustain driver 300 receives a sustain discharge control signal from controller 400, and applies a sustain discharge pulse alternately to the X and Y electrodes. The input sustain discharge pulse applied causes a sustain discharge on the selected discharge cells. Controller 400 receives an external picture signal, generates the address drive control signal and the sustain discharge control signal, and applies them to address driver 200 and scan/sustain driver 300, respectively.

Below is a description of a driver circuit of scan/sustain driver 300 according to a first embodiment of the present invention with reference to FIGS. 4 to 6.

Figure 4:
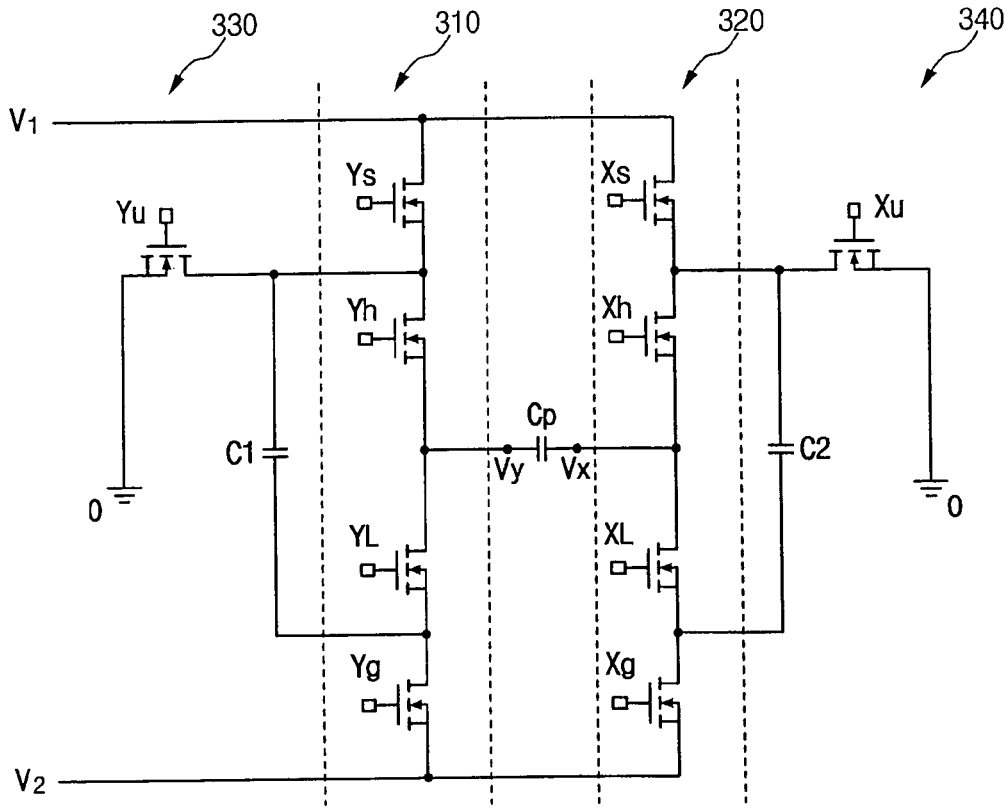
FIGS. 4, 7, and 10 are circuit diagrams showing a driver circuit of a plasma display panel according to first to third embodiments of the present invention, respectively.
Figure 5A:
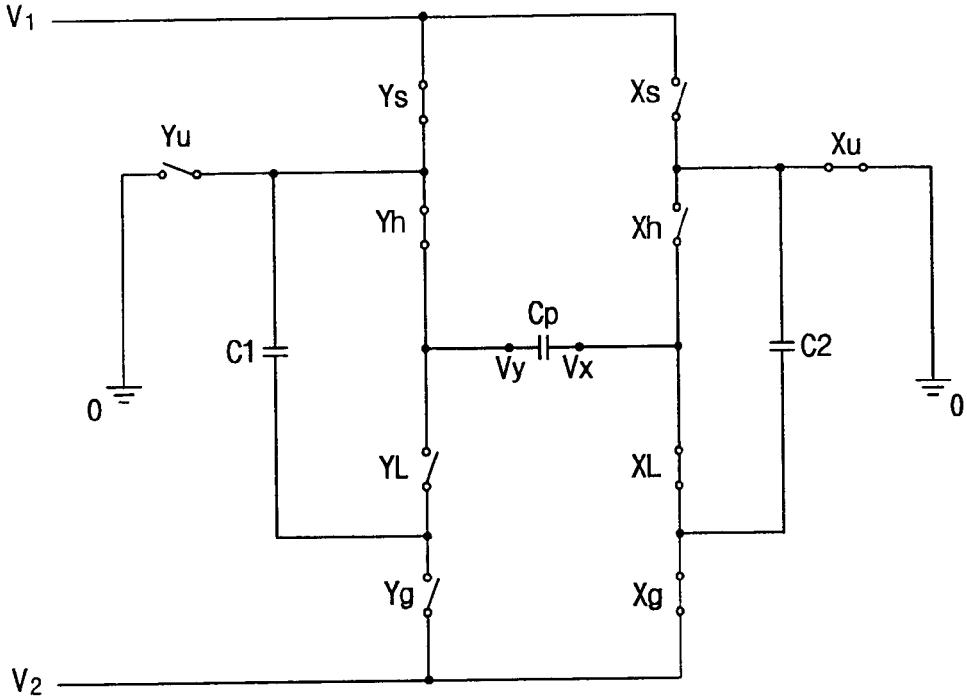
FIGS. 5A and 5B are illustrations showing a current path in each mode of the driver circuit according to the first embodiment of the present invention.
Figure 5B:
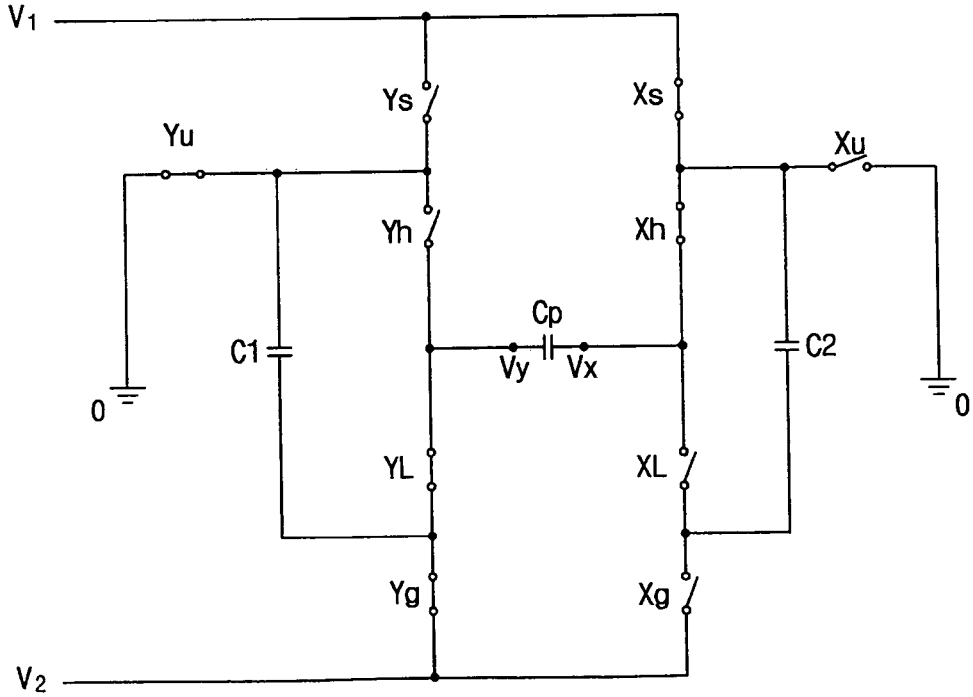

FIG. 4 is a circuit diagram of the driver circuit according to the first embodiment of the present invention. FIGS. 5A and 5B are illustrations showing a current path in each mode of the driver circuit according to the first embodiment of the present invention, and FIG. 6 is a timing diagram showing a driving operation of the driver circuits according to the first embodiment of the present invention.

The driver circuit according to the first embodiment of the present invention comprises, as shown in FIG. 4, Y electrode driver 310, X electrode driver 320, Y electrode clamping section 330, and X electrode clamping section 340.

Y electrode driver 310 and X electrode driver 320 are coupled to each other with panel capacitor Cp therebetween. Y electrode driver 310 comprises switches Ys and Yh coupled in series between power source V1 and the Y electrodes of panel capacitor Cp, and switches YL and Yg are coupled in series between the Y electrodes of panel capacitor Cp and power source V2.

Likewise, X electrode driver 320 comprises switches Xs and Xh coupled in series between power source V1 and the X electrodes of panel capacitor Cp, and switches XL and Xg coupled in series between the X electrodes of panel capacitor Cp and power source V2.

Y clamping section 330 comprises switch Yu and capacitor C1. Switch Yu is coupled between a contact of switches Ys and Yh and ground terminal 0, and capacitor C1 is coupled between the contact of switches Ys and Yh and a contact of switches YL and Yg. Likewise, X clamping section 340 comprises switch Xu and capacitor C2. Switch Xu is coupled between a contact of switches Xs and Xh and ground terminal 0, and capacitor C2 is coupled between the contact of switches Xs and Xh and a contact of switches XL and Xg.

Although switches Ys, Yh, YL, Yg, Yu, Xs, Xh, XL, Xg, and Xu included in Y and X electrode drivers 310 and 320 and Y and X clamping sections 330 and 340 are denoted as MOSFETs in FIG. 4, they are not specifically limited to MOSFETs, and may include any switches that perform the same or similar functions. Preferably, the switches have a body diode.

Below is a description of a driving method of the driver circuit according to the first embodiment of the present invention with reference to FIGS. 5A, 5B, and 6.

In the first embodiment of the present invention, it is assumed that the voltages supplied by power sources V1 and V2 are Vs/2 and −Vs/2, respectively, and that capacitors C1 and C2 are charged to voltage Vs/2. It is also assumed that voltage Vs/2 is a half of sustain discharge voltage Vs necessary for a sustain discharge of the panel.

Figure 6:
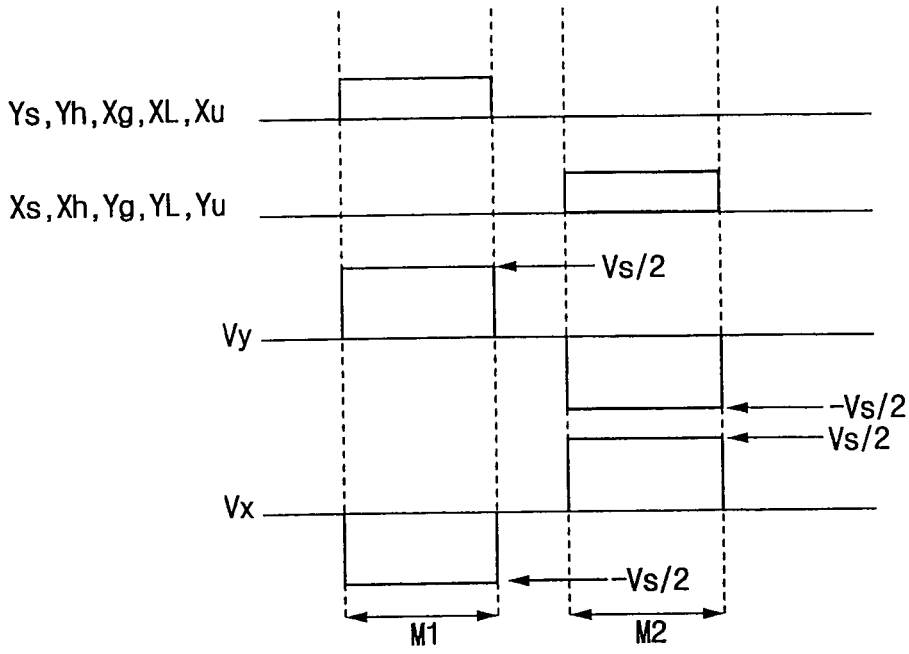
FIGS. 6 and 9 are timing diagrams showing a driving operation of the driver circuits according to the first and second embodiments of the present invention, respectively.

First, as shown in FIG. 6, in mode 1 (M1), switches Ys, Yh, Xg, XL, and Xu are turned on, with switches Xs, Xh, Yg, YL, and Yu off.

As shown in FIG. 5A, switches Ys and Yh in the on state cause voltage Vs/2 of power source V1 to be applied to the Y electrodes of panel capacitor Cp, and switches XL and Xg in the on state cause voltage −Vs/2 of power source V2 to be applied to the X electrodes of panel capacitor Cp. Y and X electrode voltages Vy and Vx of panel capacitor Cp are Vs/2 and −Vs/2, respectively, so that the voltage applied to both terminals of panel capacitor Cp is sustain discharge voltage Vs. When switch Xu is turned on, capacitor C2 is charged and clamped to voltage Vs/2 by power source V2 and ground terminal 0.

The voltage of both terminals of switch YL is clamped to voltage Vs/2 stored in capacitor C1 by the switch Yh in the on state. Switches Ys and Yh in the on state cause the voltage difference Vs between power sources V1 and V2 to be applied to switches YL and Yg. The voltage of both terminals of switch Yg is clamped to voltage Vs/2 since the voltage of both terminals of switch YL is clamped to voltage Vs/2.

Likewise, the voltage of both terminals of switch Xh is clamped to voltage Vs/2 stored in capacitor C2 by switch XL in the on state. Switches XL and Xg in the on state cause the voltage difference Vs between power sources V1 and V2 to be applied to switches Xs and Xh. The voltage of both terminals of switch Xs is clamped to voltage Vs/2 since the voltage of both terminals of switch Xh is clamped to voltage Vs/2.

Accordingly, the withstand voltages of switches YL, Yg, Xs, and Xh in the off state are clamped to Vs/2 in mode 1.

Next, as shown in FIG. 6, in mode 2 (M2), switches Xs, Xh, Yg, YL, and Yu are turned on, with switches Ys, Yh, Xg, XL, and Xu off.

As shown in FIG. 5B, switches Yg and YL in the on state cause voltage −Vs/2 of power source V2 to be applied to the Y electrodes of panel capacitor Cp, and switches Xs and Xh in the on state cause voltage Vs/2 of power source V1 to be applied to the X electrodes of panel capacitor Cp. Therefore, Y and X electrode voltages Vy and Vx of panel capacitor Cp are −Vs/2 and Vs/2, respectively, so that the voltage applied to both terminals of panel capacitor Cp is Vs.

As described in mode 1 (M1), the voltage of both terminals of switch Yh is clamped to voltage Vs/2 stored in capacitor C1 by switch YL in the on state. Since switch Yh is clamped to voltage Vs/2 and switches YL and Yg are in the on state, the voltage of both terminals of switch Ys is clamped to Vs/2 by power sources V1 and V2. Likewise, switch XL is clamped to voltage Vs/2 stored in capacitor C2, and switch Xg is clamped to voltage Vs/2 by power sources V1 and V2.

Thus, the withstand voltages of switches Ys, Yh, XL, and Xg in the off state are clamped to Vs/2 in mode 2.

According to the first embodiment of the present invention, the voltage applied to switches Ys, Yh, XL, and Xg and switches YL, Yg, Xs, and Xh is clamped to Vs/2 by capacitors C1 and C2, respectively, while the voltage of both terminals of panel capacitor Cp is maintained to voltage Vs. Furthermore, a high inrush current hardly occurs in the initial starting step, because capacitors C1 and C2 are not used for applying a negative voltage to the Y or X electrodes of panel capacitor Cp.

Because of the capacitance component of panel capacitor Cp, a reactive power as well as the power for a discharge is required in applying a waveform for a sustain discharge. A circuit for recovering the reactive power and reusing it is called "power recovery circuit". Below is a description of another embodiment having a power recovery circuit added to the driver circuit according to the first embodiment of the present invention with reference to FIGS. 7 to 9.

Figure 7:
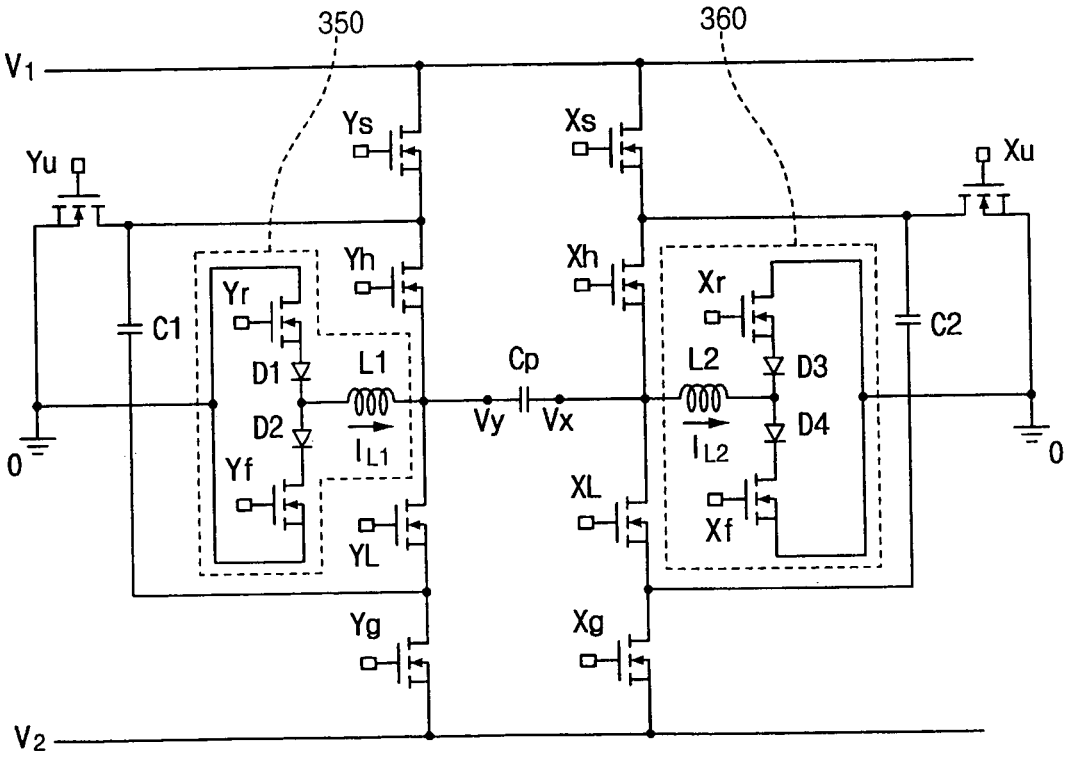

FIG. 7 is a circuit diagram of a driver circuit according to a second embodiment of the present invention.

The driver circuit according to the second embodiment of the present invention further comprises, as shown in FIG. 7, Y and X electrode power recovery sections 350 and 360 added to the driver circuit according to the first embodiment of the present invention.

Y electrode power recovery section 350 comprises inductor L1 and switches Yr and Yf. Inductor L1 is coupled to a contact of switches Yh and YL, i.e., the Y electrodes of panel capacitor Cp, and switches Yr and Yf are coupled in parallel between inductor L1 and ground terminal 0. Y electrode power recovery section 350 further comprises diodes D1 and D2 coupled between switch Yr and inductor L1 and between switch Yf and inductor L1, respectively. Diodes D1 and D2 interrupt current paths that may be formed by body diodes of switches Yr and Yf, respectively.

X electrode power recovery section 360 comprises inductor L2 and switches Xr and Xf, and additionally includes diodes D3 and D4. X electrode power recovery section 360 is the same in construction as Y electrode power recovery section 350 and will not be described in detail. Switches Yr, Yf, Xr, and Xf of Y and X electrode power recovery sections 350 and 360 may comprise MOSFETs.

Below is a description of a driving method of the driver circuit according to the second embodiment of the present invention with reference to FIGS. 8A to 8H and 9.

Figure 8A:
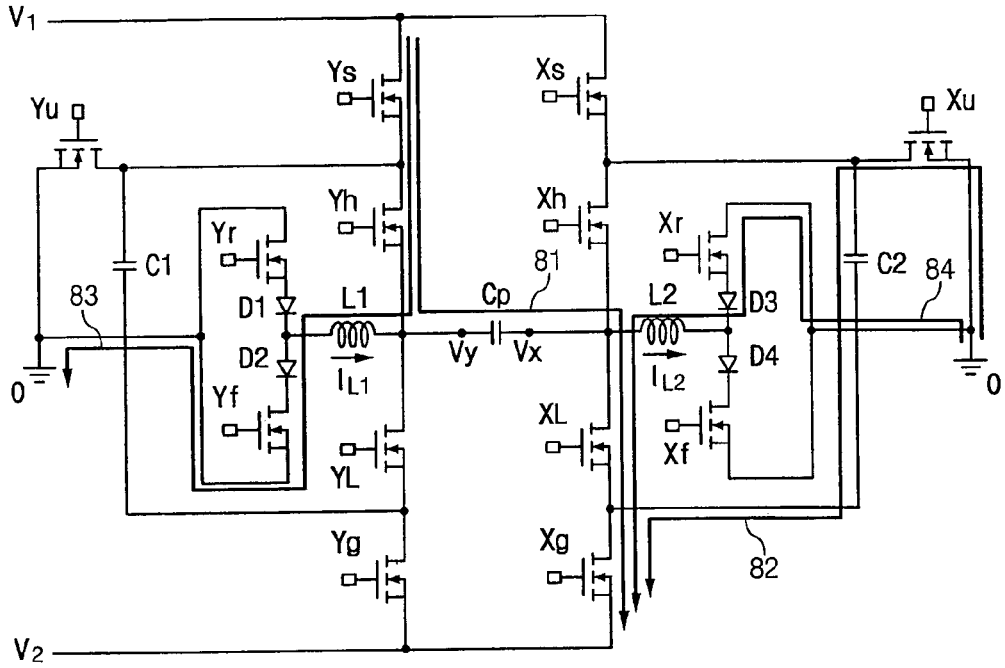
FIGS. 8A to 8H are illustrations showing a current path in each mode of the driver circuit according to the second embodiment of the present invention.
Figure 8B:
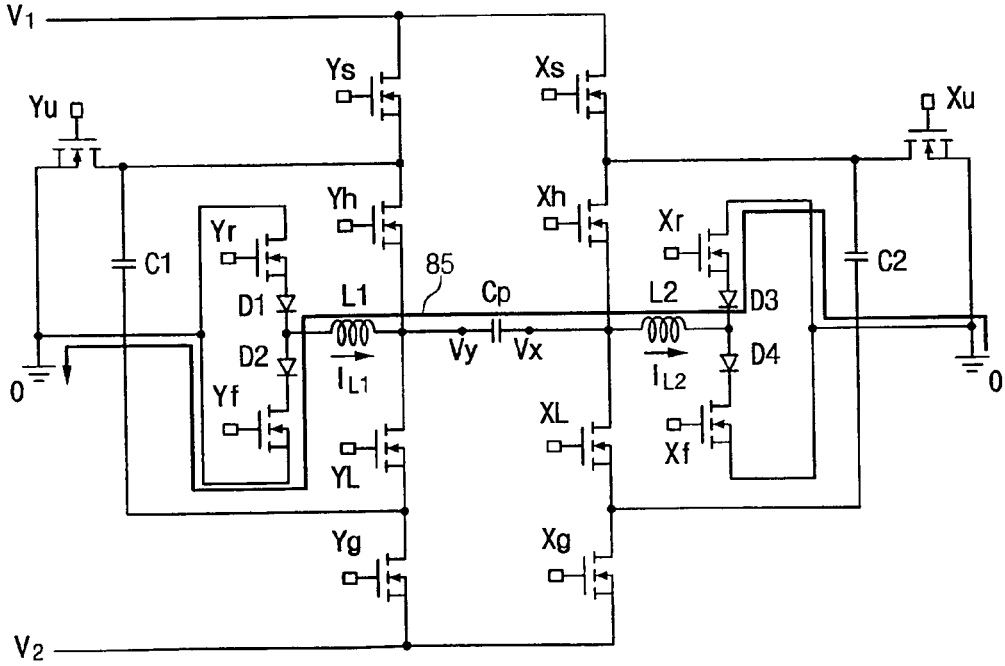
Figure 8C:
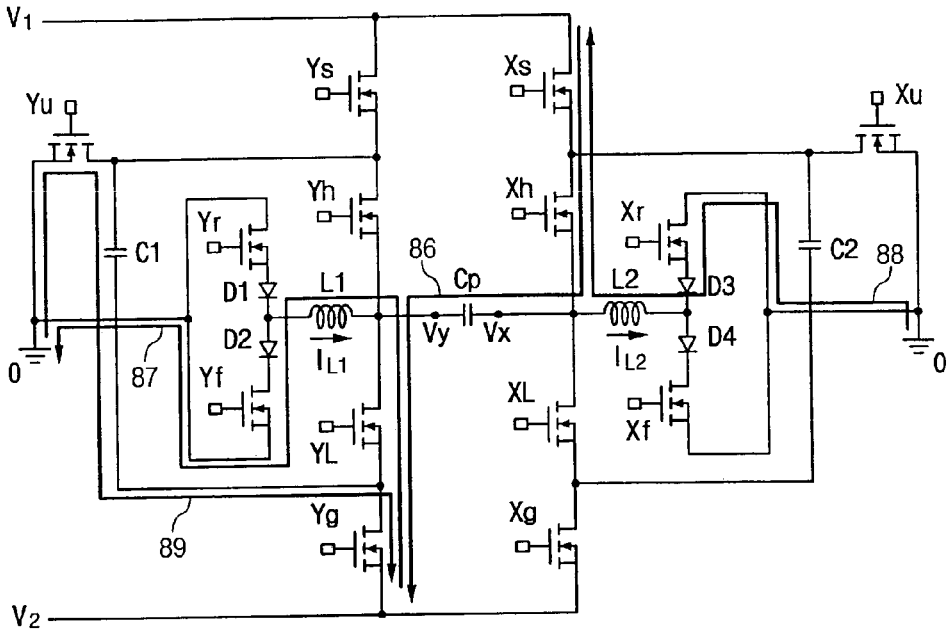
Figure 8D:
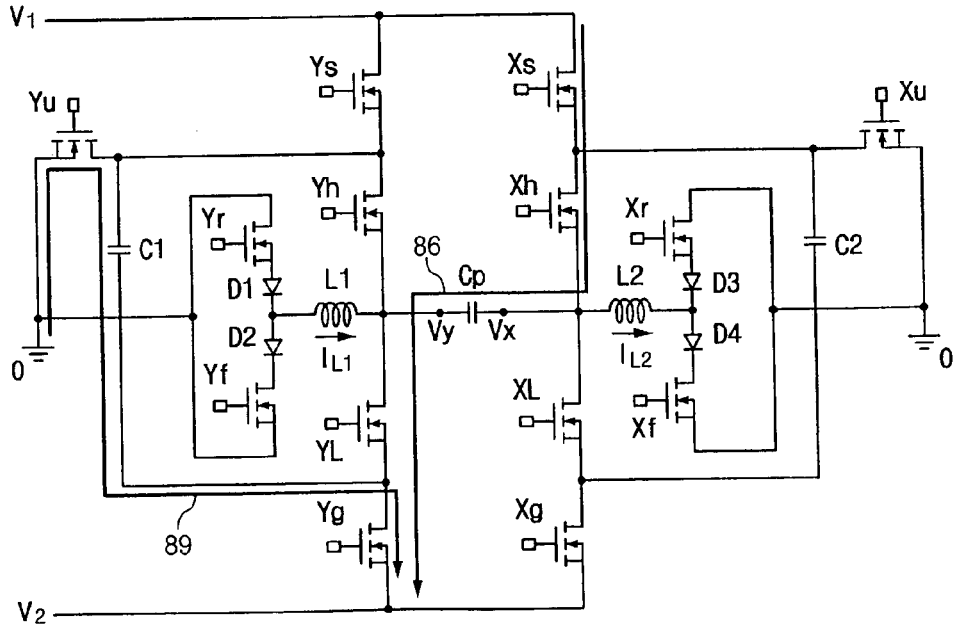
Figure 8E:
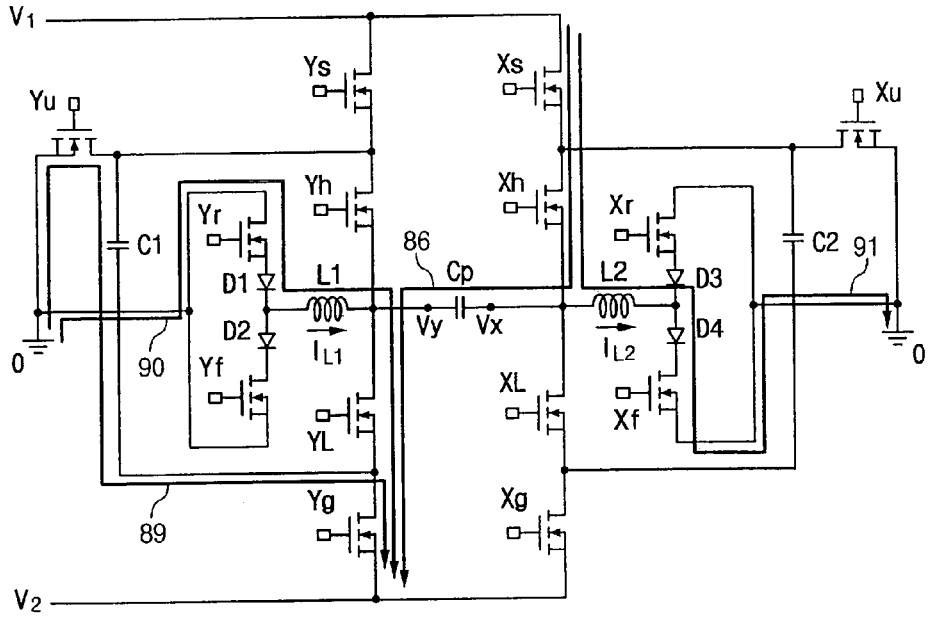
Figure 8F:
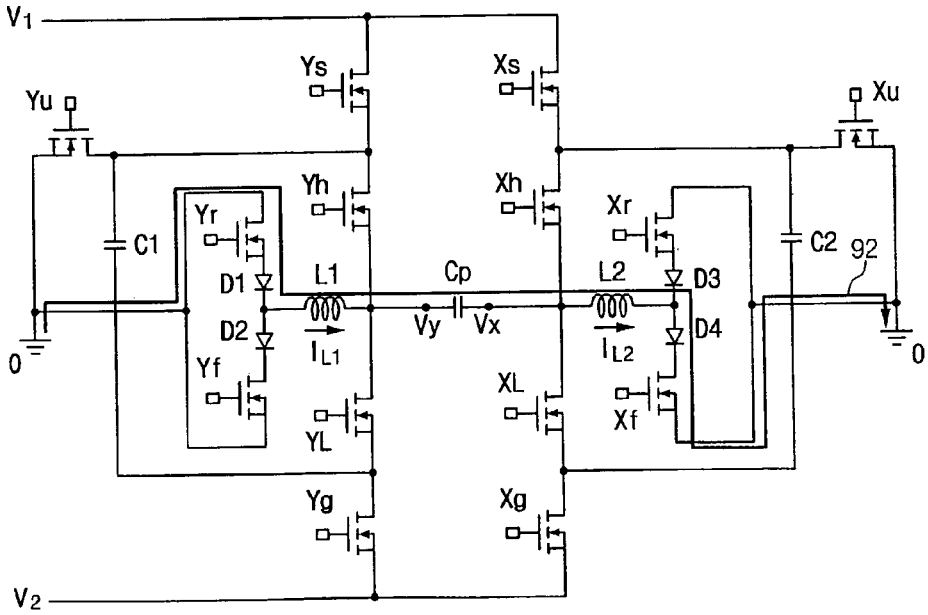
Figure 8G:
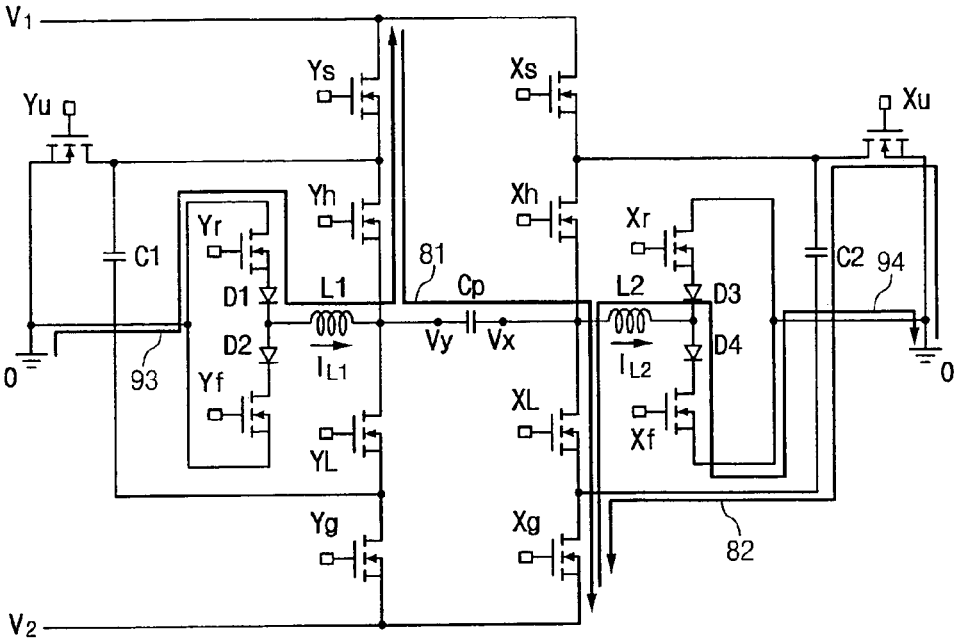
Figure 8H:
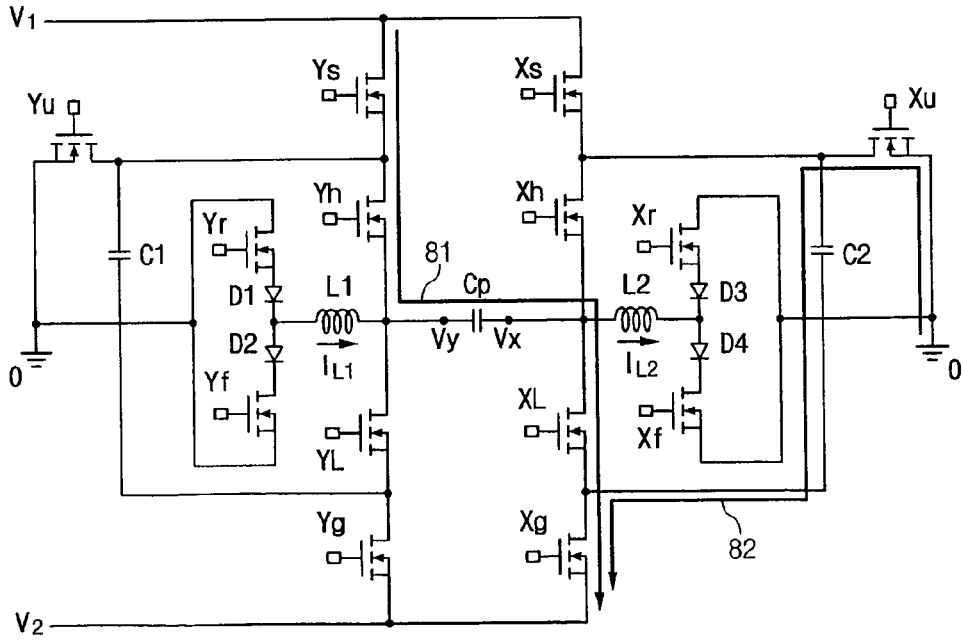
Figure 9:
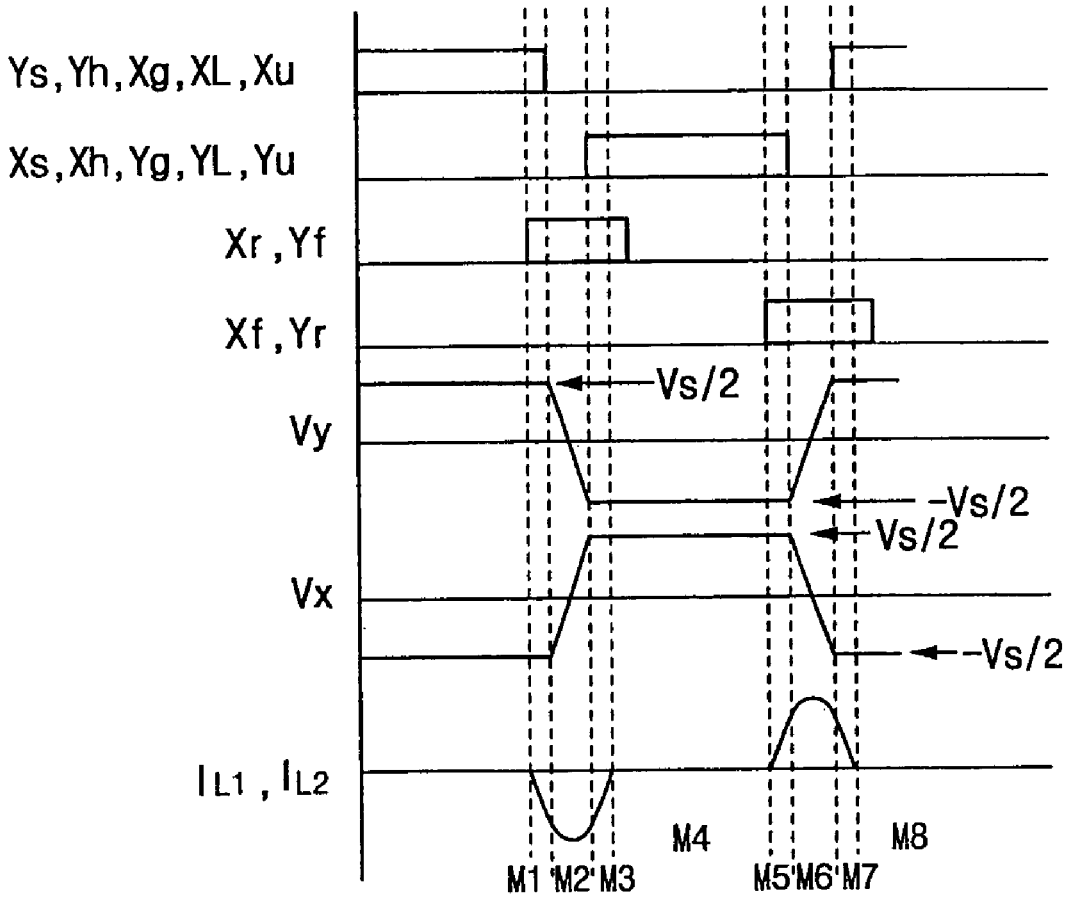

FIGS. 8A to 8H are illustrations showing a current path in each mode of the driver circuit according to the second embodiment of the present invention, and FIG. 9 is a timing diagram showing a driving operation of the driver circuits according to the second embodiment of the present invention.

In the second embodiment of the present invention, it is assumed that before the start of the mode 1 (M1), switches Ys, Yh, Xg, XL, and Xu are in the on state, with switches Xs, Xh, Yg, YL, Yu, Xr, Yf, Xf, and Yr off. It is also assumed that capacitors C1 and C2 are charged to voltage Vs/2 and that the inductance of inductors L1 and L2 is L.

Reference will be made to FIGS. 8A and 9 to describe the operation in mode 1 (M1).

Before the start of mode 1, current path 81 is formed that includes power source V1, switches Ys and Yh, panel capacitor Cp, switches XL and Xg, and power source V2. Then Y electrode voltage Vy of panel capacitor Cp is sustained at Vs/2 due to power source V1, and X electrode voltage Vx of panel capacitor Cp is sustained at −Vs/2 due to power source V2. Capacitor C2 is clamped to Vs/2 due to current path 82 which includes ground terminal 0, switch Xu, the capacitor C2, switch Xg, and power source V2. The withstand voltages of the switches YL and Yg are clamped to Vs/2 due to the voltage Vs/2 stored in capacitor C1, and the withstand voltages of the switches Xs and Xh are clamped to Vs/2 due to the voltage Vs/2 stored in capacitor C2, as described in the first embodiment.

When switches Yf and Xr are turned on, formed are current path 83 which includes power source V1, switch Ys and Yh, inductor L1, diode D2, switch Yf, and ground terminal 0, and current path 84 that includes ground terminal 0, switch Xr, diode D3, inductor L2, switches XL and Xg, and power source V2. The magnitude of currents IL1 and IL2 flowing to the inductors L1 and L2 is linearly increased with a slope of Vs/2L through current paths 82 and 83. Due to currents IL1 and IL2, energy is stored in inductors L1 and L2.

Reference will be made to FIGS. 8B and 9 to describe the operation in mode 2 (M2).

In mode 2 (M2), with switches Yf and Xr on, switches Ys, Yh, Xg, XL, and Xu are turned off. Then, current path 85 is formed that includes switch Xr, diode D3, inductor L2, panel capacitor Cp, inductor L1, diode D2, and switch Yf, so that an LC resonance current flows due to inductors L1 and L2 and panel capacitor Cp. With this LC resonance current, Y electrode voltage Vy of panel capacitor Cp is reduced to −Vs/2 and X electrode voltage Vx is increased to Vs/2. Y electrode voltage Vy does not exceed −Vs/2 due to the body diodes of switches YL and Yg, and X electrode voltage Vx does not exceed Vs/2 due to the body diodes of switches Xs and Xh.

As described above, energy is previously stored in inductors L1 and L2, and the stored energy and the LC resonance current are used for changing Y and X electrode voltages Vy and Vx of panel capacitor Cp. Thus Y and X electrode voltages Vy and Vx can be changed to Vs/2 and −Vs/2, respectively, even in the actual circuit including parasitic components.

Reference will be made to FIGS. 8C and 9 to describe the operation in mode 3 (M3).

In mode 3 (M3), when Y and X electrode voltages Vy and Vx of the panel capacitor Cp are −Vs/2 and Vs/2, respectively, the switches Xs, Xh, Yg, and YL are turned on. Then path 86 is formed that includes power source V1, switches Xs and Xh, panel capacitor Cp, switches YL and Yg, and power source V2, and Y and X electrode voltages Vy and Vx of panel capacitor Cp are sustained at Vs/2 and −Vs/2, respectively.

Current IL1 flowing to inductor L1 is recovered to ground terminal 0 through path 87 which includes the body diodes of switches Yg and YL, inductor L1, diode D2, and switch Yf. Current IL2 flowing to inductor L2 is recovered to power source V1 through path 88 which includes switch Xr, diode D3, inductor L2, and the body diodes of switches Xh and Xs. Therefore, the magnitude of currents IL1 and IL2 is linearly reduced to OA with a slope of Vs/2L.

When switch Yu is turned on, capacitor C1 is charged and clamped to voltage Vs/2 through loop 89 which includes ground terminal 0, switch Yu, capacitor C1, switch Yg, and power source V2. As described in the first embodiment, the withstand voltages of switches Ys and Yh are clamped to Vs/2 due to voltage Vs/2 stored in capacitor Cl, respectively, and the withstand voltages of switches XL and Xg are clamped to Vs/2 due to voltage Vs/2 stored in capacitor C2, respectively.

Reference will be made to FIGS. 8D and 9 to describe the operation in mode 4 (M4).

In mode 4 (M4), when currents IL1 and IL2 are 0A, switches Yf and Xr are turned off so that paths 87 and 88 are interrupted. Y and X electrode voltages Vy and Vx are still sustained at −Vs/2 and Vs/2, respectively, due to switches YL, Yg, Xs, and Xh which are turned on. In addition, the withstand voltages of switches Ys, Yh, XL, and Xg are clamped to Vs/2 as described in mode 3 (M3).

Reference will be made to FIGS. 8E and 9 to describe the operation in mode 5 (M5).

In mode 5 (M5), energy is stored in inductors L1 and L2 while Y and X electrode voltages Vy and Vx of panel capacitor Cp are sustained at −Vs/2 and Vs/2. In detail, when switches Yr and Xf are turned on, current path 90 is formed that includes ground terminal 0, switch Yr, diode Dl, inductor L1, switches YL and Yg, and power source V2, and current path 91 is formed that includes power source V1, switches Xs and Xh, inductor L2, diode D4, switch Xf, and ground terminal 0. By current paths 90 and 91, currents IL1 and IL2 flowing to inductors L1 and L2 are linearly increased with a slope of Vs/2L. The energy is stored in inductors L1 and L2 due to currents IL1 and IL2.

Reference will be made to FIGS. 8F and 9 to describe the operation in mode 6 (M6).

In mode 6 (M6), with the switches Yf and Xr on, switches Xs, Xh, Yg, YL, and Xu are turned off after the energy is stored in inductors L1 and L2. Then path 92 is formed that includes switch Yr, diode D1, inductor L1, panel capacitor Cp, inductor L2, diode D4, and switch Xf. Path 92 makes an LC resonance current flow due to the inductors L1 and L2 and the panel capacitor Cp. With this LC resonance current, Y electrode voltage Vy of panel capacitor Cp is increased to Vs/2 and X electrode voltage Vx is decreased to −Vs/2. Y electrode voltage Vy does not exceed Vs/2 due to the body diode of switches Ys and Yh, and X electrode voltage Vx does not exceed −Vs/2 due to the body diode of switches XL and Xg.

As described in mode 2 (M2), in mode (M6), after the energy is stored in inductors L1 and L2, Y and X electrode voltages Vy and Vx are changed by using this energy and the LC resonance current. Therefore Y and X electrode voltages Vy and Vx can be changed to Vs/2 and −Vs/2, respectively, even in the actual circuit including parasitic components.

Reference will be made to FIGS. 8G and 9 to describe the operation in mode 7 (M7).

In mode 7 (M7), when Y and X electrode voltages Vy and Vx are Vs/2 and −Vs/2, switches Ys, Yh, Xg, and XL are turned on to sustain these voltages Vy and Vx. Then, path 81 is formed that includes power source V1, switches Ys and Yh, panel capacitor Cp, switches XL and Xg, and power source V2 so that Y and X electrode voltages Vy and Vx of panel capacitor Cp are sustained at Vs/2 and −Vs/2, respectively.

Current IL1 flowing to inductor L1 is recovered to power source V1 through path 93 that includes switch Yr, diode D1, inductor L1, and the body diodes of switches Yh and Ys. Current IL2 flowing to inductor L2 is recovered to ground terminal 0 through current path 94 that includes the body diodes of switches Xg and XL, inductor L2, diode D4, and switch Xf.

In addition, when switch Xu is turned on, capacitor C2 is charged and clamped to Vs/2 through path 82 which includes switch Xu, capacitor C2, switch Xg, and power soured V2. As described above in regard to mode 1 (M1), the withstand voltages of switches YL and Yg, are clamped to Vs/2 due to voltage Vs/2 stored in capacitor C1, and the withstand voltages of switches Xs and Xh are clamped to Vs/2 due to voltage Vs/2 stored in capacitor C2.

Reference will be made to FIGS. 8H and 9 to describe the operation in mode 8 (M8).

In mode 8 (M8), switches Yr and Xf are turned off so that paths 93 and 94 are interrupted, when currents IL1 and IL2 flowing to inductors L1 and L2. Switches Ys, Yh, XL, and Xg in the on state cause Y and X electrode voltages Vy and Vx of panel capacitor Cp to be still sustained at Vs/2 and −Vs/2, respectively. As described in mode 7 (M7), the withstand voltages of switches Xs, Xh, YL, and Yg are clamped to Vs/2.

Subsequently, the cycle of modes 1 to 8 (M1–M8) is repeated to generate Y and X electrode voltages Vy and Vx swinging between Vs/2 and −Vs/2, thereby sustaining the potential difference between the X and Y electrodes at sustain discharge voltage of Vs.

Although each of Y and X electrode power recovery sections 350 and 360 has one inductor in the second embodiment of the present invention, all other differently modified power recovery sections may be used. For example, Y electrode power recovery section 350 may include inductors L11 and L12 each forming a different path. More specifically, energy is stored in the inductor L11 while Y electrode voltage Vy is sustained at Vs/2, and then used to change Y electrode voltage Vy to −Vs/2. Then, the energy stored in inductor L11 is recovered and energy is stored in inductor L12, while Y electrode voltage Vy is sustained at −Vs'/2. The energy stored in inductor L12 is used to change Y electrode voltage Vy to Vs/2.

Although the voltages supplied by power sources V1 and V2 are Vs/2 and −Vs/2, respectively, in the first and second embodiments of the present invention, a different voltage can also be used as long as the voltage difference between two power sources V1 and V2 is Vs which is necessary for sustain discharge. Namely, the voltages supplied by power sources V1 and V2 can be Vh and (Vh−Vs) so that Y and X electrode voltages Vy and Vx swing between Vh and (Vh−Vs).

An exemplary third embodiment in which the voltages supplied by power sources V1 and V2 of FIG. 4 are sustain discharge voltage Vs and ground voltage 0V, respectively, will be described with reference to FIG. 10.

Figure 10:
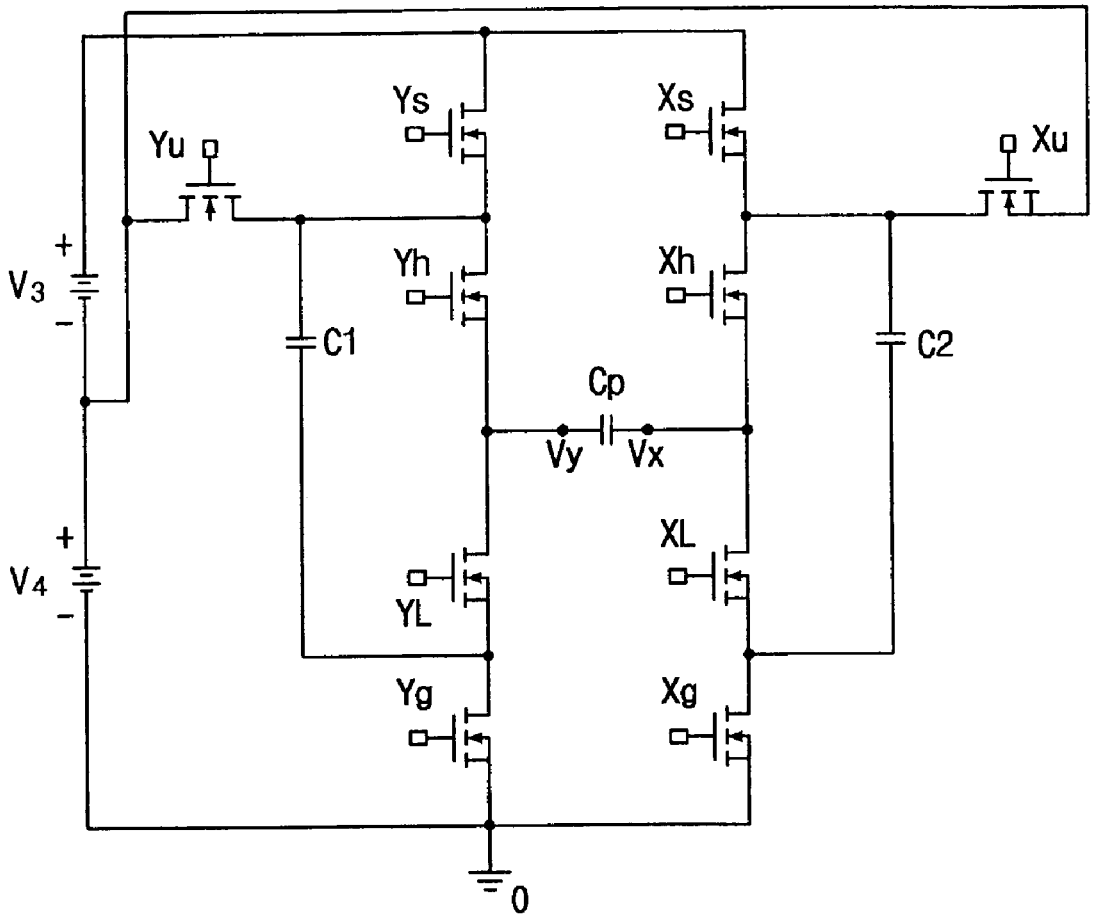

FIG. 10 is a circuit diagram showing a driver circuit of a plasma display panel according to the third embodiment of the present invention.

As shown in FIG. 10, in the driving circuit according the third embodiment, power sources V3 and V4 supply the voltages Vs/2, respectively. In detail, power sources V3 and V4 are coupled in series and supply voltage Vs. Switches Ys and Xs are coupled to power sources V3, and switches Yg and Xg are coupled to ground terminal 0. Switches Yu and Xu are a contact of power sources V3 and V4.

Except for the voltages applied to the Y and X electrode of panel capacitor Cp, the operation of the driver circuit according to the third embodiment of the present invention is the same to that of the first embodiment. In addition, capacitor C1 is charged to Vs/2 when switch Yu is turned on, and capacitor C2 is charged to Vs/2 when switch Xu is turned on.

In detail, in mode 1, voltages Vs and 0V are applied to the Y and X electrode of panel capacitor Cp, respectively. The withstand voltage of switch YL is clamped to Vs/2 due to voltage Vs/2 stored in capacitor C1. The withstand voltage of switch Yg is clamped to Vs/2 due to the voltage of both terminals Vs/2 of switch Yg and voltage Vs supplied by serially coupled power sources V3 and V4. Likewise, the withstand voltage of switch Xh is clamped to Vs/2 due to voltage Vs/2 stored in capacitor C2. The withstand voltage of switch Xs is clamped to Vs/2 due to the voltage of both terminals Vs/2 of switch Xh and voltage Vs supplied by power sources V3 and V4.

In mode 2, voltages 0V and Vs are applied to the Y and X electrode of panel capacitor Cp, respectively. As described above, the withstand voltages of switches Ys and Yh are clamped to Vs/2 due to voltage Vs/2 stored in capacitor C1 and voltage Vs supplied by power sources V3 and V4. Likewise, the withstand voltages of switches XL and Xg are clamped to Vs/2 due to voltage Vs/2 stored in capacitor C2 and voltage Vs supplied by power sources V3 and V4.

In addition, although the two switches are coupled between the power source and the X or Y electrode of panel capacitor Cp in the first to third embodiments of the present invention, the number of switches is not specifically limited in the present invention. For example, when four switches S1, S2, S3, and S4 are coupled in series between power source V1 and the Y electrode of panel capacitor Cp and switch Yu is coupled to the contact of switches S2 and S3 in FIG. 4, the withstand voltage of the switches S1 and S2 or the switches S3 and S4 is Vs/2.

According to the present invention, the withstand voltage of the switches can be half of voltage Vs necessary for sustain discharge, thereby reducing the production unit cost. The present invention also eliminates an inrush current generated when the voltage stored in an external capacitor is used in changing the terminal voltage of the panel capacitor. Furthermore, the driver circuit of the present invention can be used irrespective of the waveform of sustain pulses by changing the power source applied to it.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for driving a plasma display panel, which has a panel capacitor, the apparatus comprising:

a first switch and a second switch being coupled in series between a first power source for supplying a first voltage and a first terminal of the panel capacitor;

a third switch and a fourth switch being coupled in series between the first terminal of the panel capacitor and a second power source for supplying a second voltage;

a first capacitor coupled between a common contact between the first switch and the second switch and a common contact between the third switch and the fourth switch; and a fifth switch coupled between the first capacitor and a third power source for supplying a third voltage, wherein the third voltage is substantially a ground voltage, and wherein either the first voltage or the second voltage is a negative voltage.

2. The apparatus of claim 1, wherein the fifth switch is turned on so that the first capacitor is charged to a difference between the first voltage and the third voltage.

3. The apparatus of claim 1, further comprising:

at least one inductor coupled to the first terminal of the panel capacitor; and a sixth switch and a seventh switch being coupled in parallel between the at least one inductor and the third power source.

4. The apparatus of claim 1, wherein the first switch, the second switch, the third switch and the fourth switch each have a body diode.

5. The apparatus as claimed in claim 1, further comprising:

a sixth switch and a seventh switch being coupled in series between the first power source and a second terminal of the panel capacitor;

an eighth switch and a ninth switch being coupled in series between the second terminal of the panel capacitor and the second power source;

a second capacitor coupled between a common contact between the sixth switch and the seventh switch and a common contact between the eighth switch and the ninth switch; and a tenth switch coupled between the second capacitor and the third power source.

6. An apparatus for driving a plasma display panel, which has a panel capacitor, the apparatus comprising:

a first switch and a second switch being coupled in series between a first power source for supplying a first voltage and a first terminal of the panel capacitor;

a third switch and a fourth switch being coupled in series between the first terminal of the panel capacitor and a second power source for supplying a second voltage;

a first signal line coupled to a common contact between the first switch and the second switch; and a second signal line coupled to a common contact between the third switch and the fourth switch, wherein a voltage between the first signal line and the second signal line is a third voltage, and the first voltage and the second voltage are alternately applied to the first terminal of the panel capacitor, wherein a ground voltage is applied to the first signal line while the second voltage is applied to the first terminal of the panel capacitor, and wherein either the first voltage or the second voltage is a negative voltage.

7. The apparatus of claim 6, further comprising a capacitor coupled between the first signal line and the second signal line and charged to the third voltage.

8. The apparatus of claim 7, further comprising a fifth switch coupled between the ground voltage and the first signal line, the fifth switch being turned on thereby charging the capacitor to the third voltage in an on state of the fourth switch.

9. The apparatus of claim 6, further comprising a power recovery section including at least one inductor coupled to the first terminal of the panel capacitor, the power recovery section changing a terminal voltage of the panel capacitor using a resonance generated between the at least one inductor and the panel capacitor.

10. The apparatus of claim 9, wherein the power recovery section further includes a fifth switch and a sixth switch being coupled in parallel between the at least one inductor and a third power source, the third power source for supplying a middle voltage substantially between the first voltage and the second voltage.

11. The apparatus of claim 6, wherein the first switch, the second switch, the third switch and the fourth switch each have a body diode.

12. The apparatus of claim 6, further comprising:

a fifth switch and a sixth switch being coupled in series between the first power source and a second terminal of the panel capacitor;

a seventh switch and an eighth switch being coupled in series between the second terminal of the panel capacitor and the second power source;

a third signal line coupled to a common contact between the fifth switch and the sixth switch; and a fourth signal line coupled to a common contact between the seventh switch and the eighth switch, wherein a voltage between the third signal line and the fourth signal line is the third voltage, and the second voltage is applied to the second terminal of the panel capacitor while the first voltage is applied to the first terminal of the panel capacitor, and the first voltage is applied to the second terminal of the panel capacitor while the second voltage is applied to the first terminal of the panel capacitor.

13. A method for driving a plasma display panel by alternately applying a first voltage and a second voltage respectively through a first signal line and a second signal line both coupled to a first terminal of a panel capacitor, a first common contact being formed between a first switch and a second switch located on the first signal line and a second common contact being formed between a third switch and a fourth switch located on the second signal line, the method comprising:

applying the first voltage to the first terminal of the panel capacitor by turning on the first switch and the second switch while a third voltage is applied between the first common contact and the second common contact;

applying the second voltage to the first terminal of the panel capacitor by turning on the third switch and the fourth switch while the third voltage is applied between the first common contact and the second common contact; and applying a ground voltage to the first common contact while the second voltage is being applied to the first terminal of the panel capacitor, wherein either the first voltage or the second voltage is a negative voltage, and wherein the first voltage is supplied from a first power source coupled to the first signal line, and the second voltage is supplied from a second power source coupled to the second signal line.

14. The method of claim 13, wherein applying the second voltage to the first terminal of the panel capacitor includes charging the third voltage to a capacitor coupled between the first common contact and the second common contact.

15. The method of claim 13, wherein applying the first voltage to the first terminal of the panel capacitor further includes raising a voltage of the first terminal of the panel capacitor to the first voltage using a first resonance generated between an inductor coupled to the first terminal of the panel capacitor and the panel capacitor before the first voltage is applied to the first terminal of the panel capacitor, and wherein applying the second voltage to the first terminal of the panel capacitor further includes dropping the voltage of the first terminal of the panel capacitor to the second voltage using a second resonance generated between the inductor and the panel capacitor before the second voltage is applied to the panel capacitor.

16. The method of claim 15, wherein applying the first voltage to the first terminal of the panel capacitor further includes injecting current in the inductor through a path of a power source for supplying a fourth voltage, the inductor, and the second signal line, before the first resonance is generated, and wherein applying the second voltage to the first terminal of the panel capacitor further includes injecting current in the inductor through a path of the first signal line, the inductor, and the power source, before the second resonance is generated.

17. A method for driving a plasma display panel by alternately applying a first voltage and a second voltage respectively through a first signal line and a second signal line both coupled to a first terminal of a panel capacitor, a first common contact being formed between a first switch and a second switch located on the first signal line and a second common contact being formed between a third switch and a fourth switch located on the second signal line, the method comprising:

applying the first voltage to the first terminal of the panel capacitor by turning on the first switch and the second switch while a third voltage is applied between the first common contact and the second common contact;

applying the second voltage to the first terminal of the panel capacitor by turning on the third switch and the fourth switch while the third voltage is applied between the first common contact and the second common contact; and applying a ground voltage to the first common contact while the second voltage is being applied to the first terminal of the panel capacitor, wherein applying the second voltage to the first terminal of the panel capacitor includes charging the third voltage to a capacitor coupled between the first common contact and the second common contact and wherein either the first voltage or the second voltage is a negative voltage.

18. A method for driving a plasma display panel by alternately applying a first voltage and a second voltage respectively through a first signal line and a second signal line both coupled to a first terminal of a panel capacitor, a first common contact being formed between a first switch and a second switch located on the first signal line and a second common contact being formed between a third switch and a fourth switch located on the second signal line, the method comprising:

applying the first voltage to the first terminal of the panel capacitor;

applying the second voltage to the first terminal of the panel capacitor; and applying a ground voltage to the first common contact while the second voltage is being applied to the first terminal of the panel capacitor, wherein either the first voltage or the second voltage is a negative voltage, and wherein the applying the first voltage to the first terminal of the panel capacitor includes:

turning on the first switch and the second switch while a third voltage is applied between the first common contact and the second common contact;

raising a voltage of the first terminal of the panel capacitor to the first voltage using a first resonance generated between an inductor coupled to the first terminal of the panel capacitor and the panel capacitor before the first voltage is applied to the first terminal of the panel capacitor;

dropping the voltage of the first terminal of the panel capacitor to the second voltage using a second resonance generated between the inductor and the panel capacitor before the second voltage is applied to the panel capacitor; and injecting current in the inductor through a path of a power source for supplying a fourth voltage, the inductor, and the second signal line, before the first resonance is generated, and wherein the applying the second voltage to the first terminal of the panel capacitor includes:

turning on the third switch and the fourth switch while the third voltage is applied between the first common contact and the second common contact; and injecting current in the inductor through a path of the first signal line, the inductor, and the power source, before the second resonance is generated.

* * * * *